United States Patent [19]

High

[11] Patent Number: 4,790,806

[45] Date of Patent: Dec. 13, 1988

[54] DECANTER CENTRIFUGE INCORPORATING AIRLIFT DEVICE

[76] Inventor: Robert E. High, 358B Mona Vale Road, St. Ives, New South Wales 2075, Australia

[21] Appl. No.: 176,255

[22] Filed: Mar. 31, 1988

[30] Foreign Application Priority Data

Apr. 21, 1987 [AU] Australia ..... PI1512

[51] Int. Cl.[4] ..... B04B 11/00

[52] U.S. Cl. ..... 494/26; 494/53; 494/56

[58] Field of Search ..... 494/52, 53, 54, 55, 494/56, 58, 59, 23, 26, 27, 28, 29; 210/781, 782

[56] References Cited

U.S. PATENT DOCUMENTS

| | | | |
|---|---|---|---|
| 3,092,582 | 6/1963 | Lacker | 494/53 |
| 3,885,734 | 5/1975 | Lee | 494/56 |
| 3,934,792 | 1/1976 | High | 494/54 |
| 4,496,340 | 1/1985 | Redeker | 494/53 |

*Primary Examiner*—Robert W. Jenkins

*Attorney, Agent, or Firm*—Ladas & Parry

[57] ABSTRACT

A decanter centrifuge which includes an annular bowl, a hollow tube on the axis of the bowl, and means for discharging from the bowl a first phase of an input sludge, the centrifuge being characterized by a fluid-activated airlift device which includes a discharge line radially supported from the hollow tube, and a fluid supply line for conveying fluid from within the hollow tube to an outer end portion of the discharge line to effect removal from the bowl through said line of another phase of the sludge.

9 Claims, 4 Drawing Sheets

DECANTER CENTRIFUGE INCORPORATING AIRLIFT DEVICE

This invention relates to decanter centrifuges.

Such apparatus comprises a horizontally disposed elongated bowl rotatably supported upon spaced bearings and through which extends a screw conveyor rotating at a different speed from the bowl. Sludge is introduced into a cylindrical chamber near one end of the rotating bowl to form, under centrifugal force, an annular pond around the bowl wall, the internal level of which impinges upon a conical-beach near the opposite end of the bowl. Transport by the screw conveyor of heavy phase solids from the bowl wall of the cylindrical section to solids discharge ports at the remote end of the beach section is frequently a problem. The screw conveyor must lift the sedimented solids from a zone of high centrifugal force at the intersection of the cylindrical and conical-beach sections of the bowl to a zone of lower centrifugal force at the solids discharge ports. Soft sludges tend to flow back between the conveyor flights and through the gap between the outside diameter of the screw conveyor and the inside surface of the conical section of the bowl.

Various means for assisting the discharge of soft heavy phase sludges have been developed, one such method being described in U.S. Pat. No. 3,934,792 which incorporates a baffle between the slurry feed inlet area and the cake discharge ports. This baffle allows the setting of a liquid discharge port at a radius smaller than the radius for the cake discharge ports, the greater hydrostatic pressure on the feed side of the baffle assisting in the discharge of the soft sludge. A disadvantage of this arrangement is that fine high density particles settle out of the thickened sludge and accumulate in the bowl, particularly in the region of the intersection between the cylindrical and conical portions. This accumulation of fine particles impedes the flow of soft sludge and can cause severe abrasion It is the main object of the invention to provide a decanter centrifuge of a construction which alleviates this problem.

In accordance with the invention there is provided a decanter centrifuge for the separation and recovery from an input sludge of at least a light phase and a heavy phase material, comprising an annular bowl, a hollow tube extending axially through said bowl, means for discharging from at least one end of said bowl one of said material phases, and an airlift device supported by said hollow tube for collecting from within said bowl during operation of said centrifuge another of said material phases and conveying said other phase to discharge means, said airlift device including a first part connected with said hollow tube and receiving therefrom fluid for activating said airlift device and a second part protruding from said first part and radially into said bowl and receiving said activating fluid for collection of said other material phase.

It is to be understood that where reference is made to an "airlift device" it is to be understood that the device may be activated by any fluid of lesser density than at least one of the phases of the input sludge, and not necessarily air.

The invention will be described in more detail with reference to the accompanying drawings, in which.

Figure 1:
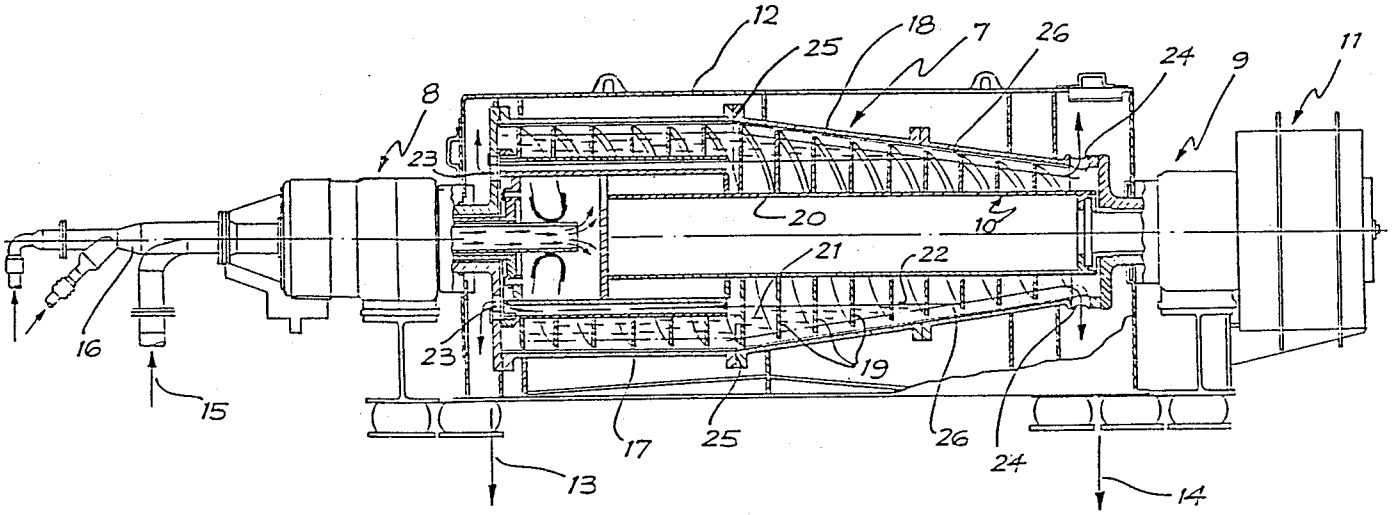
FIG. 1 shows in longitudinal section a conventional type of decanter centrifuge.

A conventional decanter centrifuge as depicted in FIG. 1, comprises an annular bowl 7 mounted for rotation between end bearings 8 and 9 with a coaxially arranged screw conveyor 10 rotatable within the bowl 7. A driving pulley system 11 serves to rotate the bowl 7 at a different speed from the conveyor 10. A stationary outer casing 12 encloses the bowl 7 and is provided with outlets 13 and 14 for collection of separated phases from a sludge 15 introduced along the manifold 16 to the interior of the bowl 7. The bowl 7 is provided with a cylindrical portion 17 and a conical-beach portion 18 both of which are swept by helical flights 19 radially mounted upon a hollow hub 20 of the flight conveyor 10.

During operation of the centrifuge the sludge 15, under centrifugal action, forms an annular pool 21 whereby light phase material is discharged from the bowl 7 via orifices 23 when the inner level 22 of the pool 21 overflows same. The inner level 22 impinges upon the conical-beach portion 18 short of heavy phase discharges orifices 24 at the outer end of the beach portion 18. Heavy phase material 14 in the form of sedimented solids from the sludge 15 is advanced up the beach portion 18 by the flights 19 of the conveyor 10 for discharge through the orifices 24. Sedimented solids, as stated above, must be lifted by the screw conveyor 10 from a zone of high centrifugal force, at the intersection 25 between the cylindrical portion 17 and the conical-beach portion 18 of the bowl 7, to the zone of lower centrifugal force existing at the discharge orifices 24. The invention in one form seeks to overcome the problem of soft sludges tending to flow back between the conveyor flights 19 and through the gap 26 between the flights 19 and the wall of the bowl 7 at the beach portion 18.

Generally the invention provides, in one form, a means of pumping the soft sludge accumulating in the area of the intersection 25 radially into the hub 20 of the screw conveyor 10 from where these solids may readily flow to a cake discharge port. The pumping action is achieved by the functioning of an airlift pump mounted on the screw conveyor 10. Preferably, two identical pumps are utilised located at radially opposite portions of the screw conveyor 10. Compressed air from an external compressor is conducted by pipe line through the hub 20 and via a suitable rotary seal arrangement. By controlling the flow of compressed air to the airlift device the rate of solids discharge and hence the solids discharge concentration can be continuously regulated. Coarse particles of the heavy phase material are prevented from entering the airlift device by virtue of a narrow clearance between the sludge inlet to the airlift device and the inside surface of the wall of the bowl. If oversized particles are removed from (or absent in) the feed slurry all of the sedimented solids can be discharged by means of the airlift device, and the conical-beach portion 18 of the decanter bowl 7 is not required. In this instance the cylindrical bowl section can be replaced with a conical section having a greater diameter at the heavy phase discharge end than at the feed end. This results in a reduction of the torque required to rotate the screw conveyor relative to the bowl and reduces abrasive wear on the flight tips. It would be possible, while retaining the conveyor flights 19 and a cylindrical wall 17 to provide an enlarged stepped portion in the wall in the vicinity of the lines 30 to create an area of higher centrifugal force to assist in the further concentration of the sludge solids.

Figure 2:
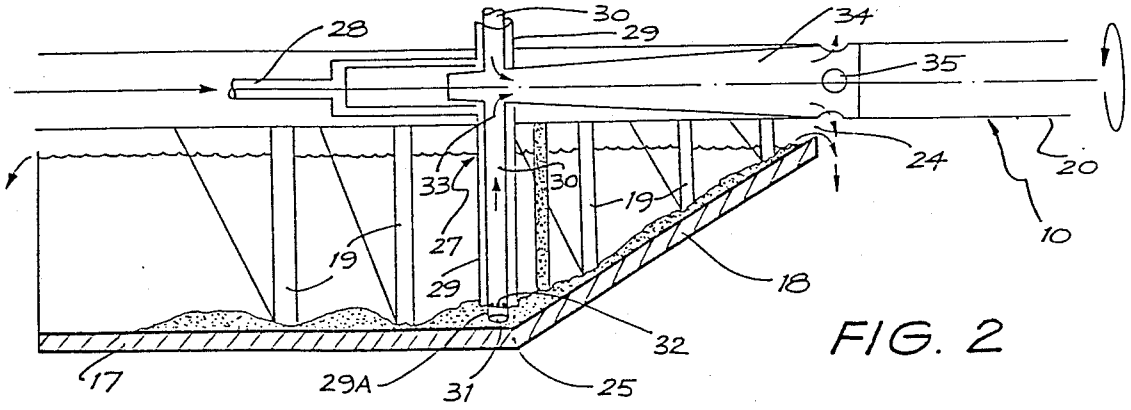
FIG. 2 is a fragmentary longitudinal section with an airlift device of this invention incorporated within the bowl of a decanter centrifuge.

As shown in FIG. 2 the airlift device 27 consists of an airline 28 axially disposed within the hub 20 connected to one or more radially extending tubes 29 extending through the wall of the hub 20 and terminating short of the intersection 25 between the portions 17 and 18 of the bow 7. The pipes 29 may have closed outer ends 29A penetrated by respective internal discharge lines 30 open at their outer ends to form mouths 31 as an inlet port to the airlift device 27. The lines 30 are provided with perforations 32 within the end 29A of each pipe 29. The inner ends 33 of the discharge lines 30 communicate with a discharging funnel 34 having radial ports 35 for discharge of solid phase material from the hub 20 of the screw conveyor 10. The airlift device 27 operates to effect pumping by virtue of air bubbles entering each line 30 mixing with the sludge therein to reduce its density and thereby establish a lower-hydrostatic head within the line. The degree can be controlled by the proportion of air bubbles in the line 30.

Figure 3:
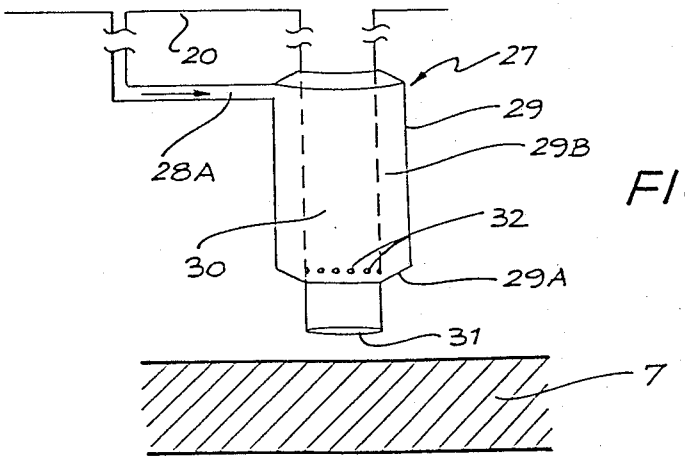
FIG. 3 is a diagrammatic representation of a modified detail of the arrangement of FIG. 2.

Thus, it will be seen that when pressurised air is applied to the airlift device 27 with the mouths 31 of the discharge lines 30 sweeping around the bowl 7 in the vicinity of the intersection 25, due to the different speed of rotation of the bowl 7 from the screw conveyor 10, heavy phase material will be lifted by the device 27 into the hub 20 and discharged through the ports 35. FIG. 3 diagrammatically depicts fragmentarily. and to a larger scale, a modified form in which the pipe 29 is separate from the hub 20 and encloses a chamber 29B. which may be open at its lower end and supplied with air from one end of an airline 28A which at its other end is connected with the interior of the hub 20 for obtaining air supply.

Figure 4:
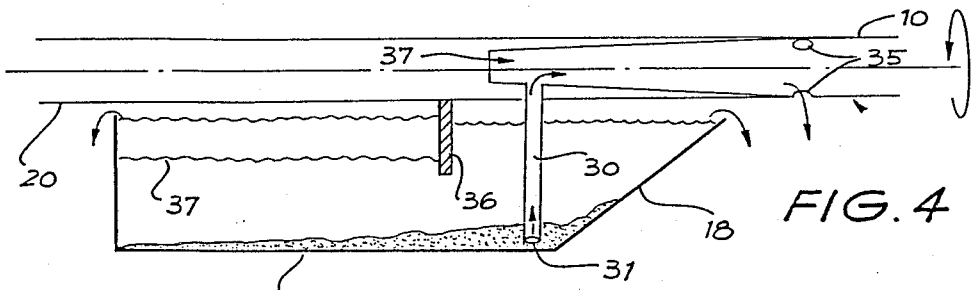
FIG. 4 shows the same device incorporated in a centrifuge of modified form.

In the arrangement depicted in FIG. 4 the flights of the screw conveyor 10 have been omitted for clarity, and a centrifuge decanter is shown capable of three-phase separation. Additionally an annular baffle 36 is fixed upon the hub 20 of the screw conveyor 10 and functions to provide an interface 37 between different phases such as oil and water, the baffle 36 serving to generate a significant residence time of the light phase. i.e. oil, within the bowl 7.

Figure 5:
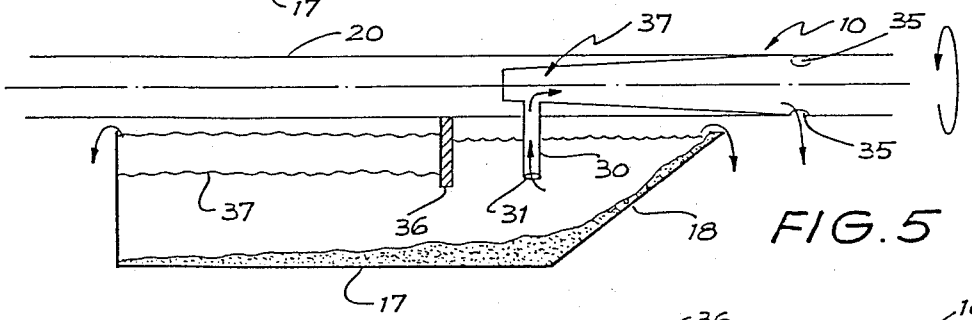
FIG. 5 shows a different arrangement of the airlift device within the bowl.
Figure 6:
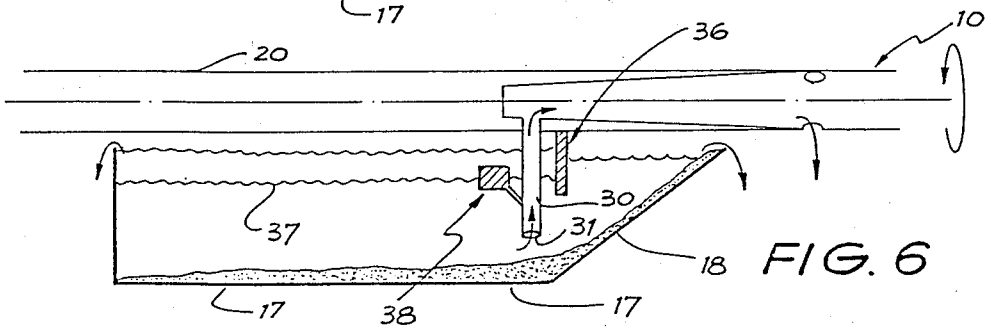
FIG. 6 is a modified version of the embodiment of FIG. 5.

FIGS. 5 and 6 depict other forms of three-phase decanter centrifuges, the former including the baffle 36 of similar length to that shown in FIG. 4 and in which the discharge line 30 is of shortened length to serve solely for pumping of water from the bowl 7. In this instance solids will be discharged in a conventional manner by the flights 19 of the screw conveyor 10. FIG. 6 additionally includes a float control 38 to control the level of the oil/water interface 37 by automatically regulating the supply of air flow to the discharge line 30. The necessary control may be effected in the conventional manner of operation of a float valve whereby air supply to the discharge line 30 is shut off whenever the interface level 37 falls to a predetermined level.

Figure 7:
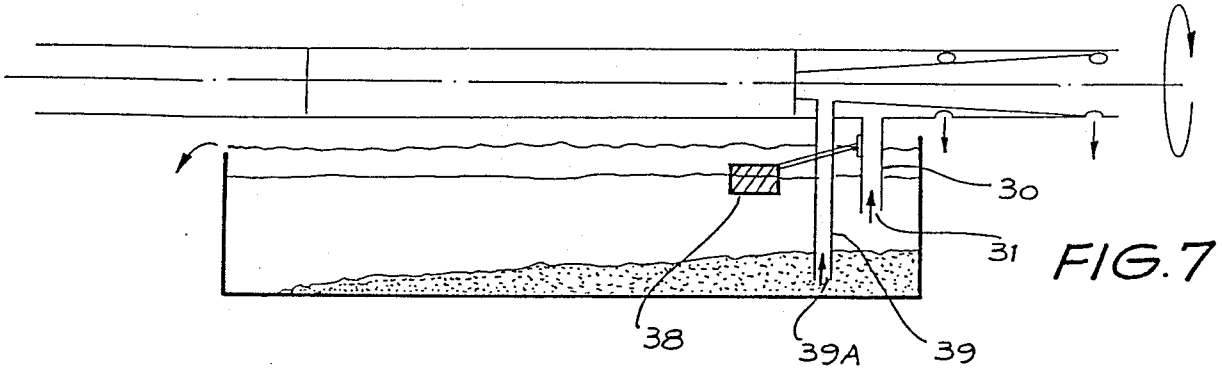
FIG. 7 shows the invention applied to another form of centrifuge.

FIG. 7 shows another form of centrifuge in which the annular bowl 7 has a purely cylindrical wall and, although not shown for simplicity, incorporates a screw conveyor for advancing the solid phase along the bowl to the solids recovery area. It also includes a float control 38 pivoted with respect to the water discharge line 30 in a similar fashion to that shown by FIG. 6. In this instance the float control 38 functions to ensure that the mouth 31 of the line 30 is always immersed within the water phase. An additional discharge line 39 has its mouth 39A immersed within the solids phase accumulation within the bowl 7 during its rotation and to ensure that this always occurs a further float control (not shown) may be associated therewith. In all instances individual ar feeder tubes (not shown}supply air from the hub 10 to the discharge lines 30 and 39 for adequate working of the respective airlift device. As an alternative, to the use of the further float control for the line 39, a pivoted paddle sensor (not shown) may be incorporated to control air supply by responding to the force imposed upon its sensor blade by the amount of solid phase material being advanced towards the sensor by the screw conveyor flights.

Figure 8:
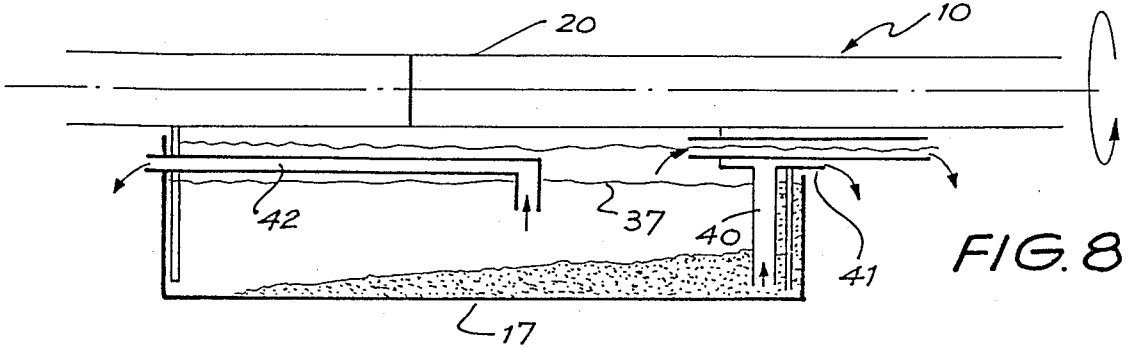
FIG. 8 depicts a modified form of airlift device applied to a similar centrifuge as shown in FIG. 7.

FIG. 8 depicts another arrangement with a similar bowl 7 to FIG. 7 which can be utilized with heavier sludges. Due to a distinct difference in the hydraulic balance level between the lighter phases and the heavy phase of the sludge, it becomes possible to pump the sludge to a larger radius for discharge than is required for discharge of the lighter phases. That is to say that removal of the heavy phase by the airlift device 40 is assisted by hydrostatic pressure as discharge thereof occurs by a duct 41 entirely beneath the surface of the light phase which is shown as oil. The water discharge can be effected solely by the hydrostatic pressure through the discharge line 42.

Whereas a principal embodiment and modified forms have been disclosed in the foregoing passages, it is to be understood that other forms, modifications and refinements are feasible within the scope of this invention.

What I claim is:

1. A decanter centrifuge for the separation and recovery from an input sludge of at least a light phase and a heavy phase material, comprising an annular bowl, a hollow tube extending axially through said bowl, means for discharging from at least one end of said bowl one of said material phases, and a fluid-activated airlift device supported by said hollow tube for collecting from within said bowl during operation of said centrifuge another of said material phases and conveying said other phase to discharge means, said airlift device including a first part supported by said hollow tube and extending radially therefrom into said bowl and a second part connected to receive a fluid supply from said hollow tube and being connected to introduce said fluid supply into said first part to activate said airlift device for collection of said other material phase.

2. A decanter centrifuge as claimed in claim 1, wherein said first part communicates with the interior of said hollow tube for discharge of said other phase, said second part of the airlift device is a pipe radially disposed upon said hollow tube, and said first part of the airlift device is a discharge line coaxial with said pipe and protruding through an outer end thereof, and has an open mouth for collection of said other material phase and at least one perforation in its wall to receive said activating fluid from said second part.

3. A decanter centrifuge as claimed in claim 1, wherein said first part communicates with the interior of said hollow tube for discharge of said other phase, and said second part comprises a fluid insertion element attached to said first part remote from said hollow tube, and an airline interconnects said element with the interior of said hollow tube for providing fluid supply to activate said airlift device.

4. A decanter centrifuge as claimed in claim 3, wherein said annular bowl has an internal cylindrical portion longitudinally adjoining a conical-beach portion, the hollow hub is rotatable and supports a plurality of helical screw conveyor flights, and the open mouth of said discharge line is positioned adjacent the join between the cylindrical portion and the conical-beach portion to discharge in operation of said centrifuge a heavy phase material from said bowl.

5. A decanter centrifuge as claimed in claim 3, wherein said annular bowl has an internal cylindrical portion longitudinally adjoining a conical-beach portion, the hollow hub is rotatable and supports a plurality of helical screw conveyor flights, and the open mouth of said discharge line is positioned in an area occupied by a light phase material during operation of said centrifuge to effect discharge of said light phase material from said bowl.

6. A decanter centrifuge as claimed n claim 5, wherein an annular radially extending baffle is fixed to said hollow tube and extends to a depth within said bowl beneath the interface level of two different light phase materials, and said discharge line is located between said baffle and the conical-beach portion of said bowl.

7. A decanter centrifuge as claimed in claim 6, comprising also a device controlling delivery of said activating fluid to said discharge line and which includes an actuating float buoyant at the interface of two of said phases.

8. A decanter centrifuge as claimed in claim 3, wherein said second part of said airlift device conveys said other phase to said discharge means via a duct positioned entirely beneath the surface of the sludge in said bowl during operation of said centrifuge, whereby the action of said airlift device is assisted by hydrostatic pressure of said sludge.

9. A decanter centrifuge as claimed in claim 1, comprising also a device controlling delivery of said activating fluid to said discharge line and which includes an actuating float buoyant at the interface between said two phases.

* * * * *